US005151034A

United States Patent [19]

Chandler et al.

[11] Patent Number: 5,151,034

[45] Date of Patent: Sep. 29, 1992

[54] CONNECTOR RETAINER

[75] Inventors: Kirk R. Chandler, Garland; Robert W. McKenzie, Lewisville, both of Tex.

[73] Assignee: Alcatel Network Systems, Inc., Richardson, Tex.

[21] Appl. No.: 772,076

[22] Filed: Oct. 7, 1991

[51] Int. Cl.[5] ..... H01R 9/09

[52] U.S. Cl. ..... 439/79; 439/372

[58] Field of Search ..... 439/78, 79, 345, 350, 439/357, 358, 372

[56] References Cited

U.S. PATENT DOCUMENTS 4,076,204 2/1978 Kalka ..... 439/372 X
4,407,556 10/1983 Hoschett ..... 439/79 X
4,418,976 12/1983 Lenzini et al. ..... 439/79 X
4,971,571 11/1990 Puerner ..... 439/372 X

OTHER PUBLICATIONS

IBM Technical Disclosure Bulletin, vol. 30, No. 12, May 1988.

*Primary Examiner*—Neil Abrams
*Assistant Examiner*—Khiem Nguyen
*Attorney, Agent, or Firm*—Bruce C. Lutz; Dennis O. Kraft

[57] ABSTRACT

A connector retainer is illustrated for use with at least two inline sets of right angle electrical connector pins whereby the connector retainer flexibly partially encloses and interlocks with the connector and has an extension thereof inserted in the right angle portion of the electrical pins wherein the inserted portion is of a larger diameter than the distance between the inline sets of pins. Such a portion can fit in the right angle portion between the sets of the pins and provide a hinge-type function without being able to move either horizontally or vertically thereby retaining the connector in contact with the electrical pins.

6 Claims, 1 Drawing Sheet

CONNECTOR RETAINER

THE INVENTION

The present invention is generally related to electrical connectors and more specifically to electrical connectors which make contact with a set of right angle electrical pins and even more specifically to a retainer for preventing a double row connector from being accidentally dislodged from two parallel sets of inline right angle electrical pins.

BACKGROUND

In the prior art, connectors have been designed in various ways to interact with electrical circuit bases in a manner to prevent accidental removal of the connector from the electrical pin connection. Also, various retainers have been devised to secure an electrical connector to the base portion, printed circuit portion, or whatever, of an electric circuit to prevent accidental removal of the connector. The present invention is related to an existing product comprising a connector to be used with an existing set of electrical pins which are mounted in a printed circuit board where the connector is parallel to the surface of the board. In other words, two inline sets of electrical pins rise vertically out of the board and are bent or otherwise formed to a right angle as compared to the connection thereof to the board. There have been field failures of this connection with the socket assembly (electrical connector) sliding off the electrical pins (probably due to vibration). Thus, a positive locking mechanism was required to prevent such disconnection.

The present invention solves this problem by securing a retainer to the connector using a partial enclosure and a flexible tab interlocking mechanism to prevent movement of the retainer relative the connector and uses hinge pins on arms or extensions from the retainer in the right angle portion between sets of inline pins to prevent movement of the retainer relative the pins. The diameter of the hinge pins is greater than the spacing between the sets of electrical pins and thus, the hinge pins cannot move in either a horizontal or vertical direction, therefore, the retainer can only rotate about the hinge pins. The diameter of the hinge pins can be as much as 28% greater than the spacing distance between the sets of electrical pins. In this manner, the connector is locked in place relative the pins via the retainer. The retainer can still be disengaged from the connector but not be lost since it is held in place due to the hinge interaction and is merely moved up out of the way when access to the connector is required. The retainer can be rotated back and snapped in place when the connector is re-attached to the electrical pins of the board.

It is therefore an object of the present invention to provide an improved connector retainer mechanism;

Further objects and advantages of the present invention will be apparent from a reading of the specification and appended claims in conjunction with the drawings wherein:

DETAILED DESCRIPTION

Figure 1:
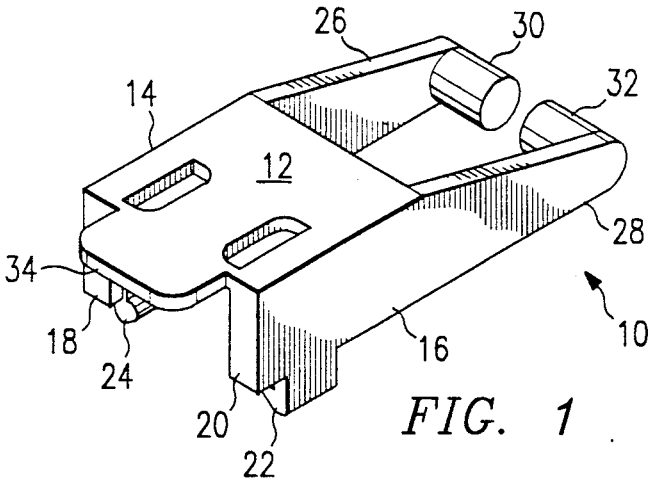
FIG. 1 is an isometric view of the retainer itself.

In FIG. 1 the retainer is shown generally as 10 with a top portion 12 and first and second side portions 14 and 16. Portions 12, 14 and 16 form a generally U-shaped enclosure for fitting over a connector body. Additionally, portions 18 and 20 are shown which extend inwardly from the inside surface of portions 14 and 16. Tabs 22 and 24 are shown at the lower extremity of the side portions 14 and 16. The tabs 22 and 24, in one embodiment of the invention, along with their associated side portions, flex such that they clamp the underside of a connector body. The device 10 also has extensions in the form of arms 26 and 28 extending backwardly from the side portions 14 and 16. Extending inwardly towards each other from the arms 26 and 28 are hinge pins 30 and 32. A tab 34 is shown at the front edge of portion 12 to use as an aid in unsnapping the retainer from the connector and allowing it to revolve around the hinge pins 30 and 32. The back portion of 12 between arms 26 and 28 may be referred to as a bit portion.

Figure 2:
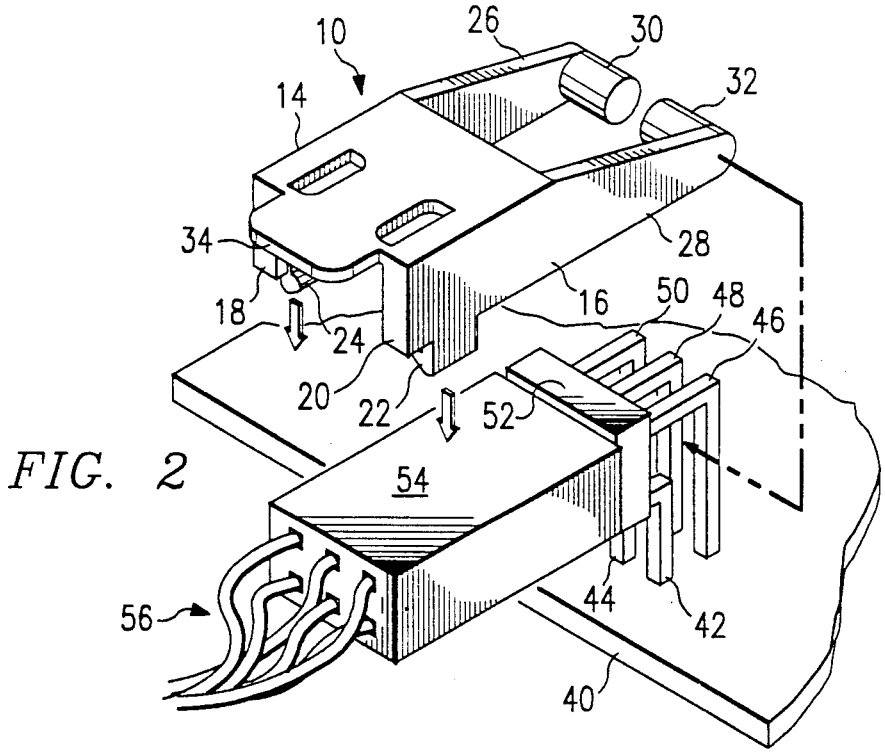
FIG. 2 is an isometric drawing of the retainer as it would be attached to a connector and its associated electrical pins.

The same numbers as used in FIG. 1 are used again in FIG. 2 where appropriate. As further shown in FIG. 2, a printed circuit board 40 is illustrated with a plurality of electrical connection pins extending upwardly therefrom. A first pin is designated as 42 in a front row (a first set) of pins along with an adjacent pin 44. In the back row there is a second set of pins. These are designated pins 46, 48 and 50. A pin corresponding in position to pin 50 but on the side nearest the edge of the board is not illustrated.

A header 52 operates to keep the pins 42 through 50 properly spaced and further is used to hold the pins in position so that the two sets of pins can be inserted into the printed circuit board 40 and soldered. A connector generally labeled as 54 has a plurality of wires 56 which are electrically connected to female wipers (not shown) inside connector body 54. Connector 54 is shown in an engaged position with the ends of the two sets of male pins as they extend through the header 52 into the internal portion of connector 54.

Figure 3:
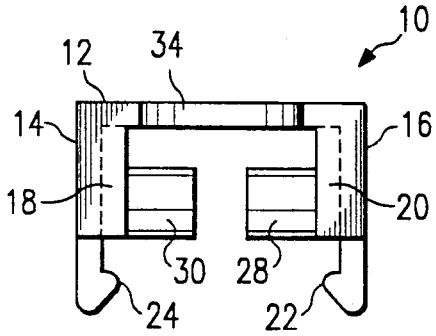
FIG. 3 is an end view of the retainer of FIG. 1.

FIG. 3 uses the same numbering system as used in FIGS. 1 and 2 and no additional items are illustrated.

Figure 4:
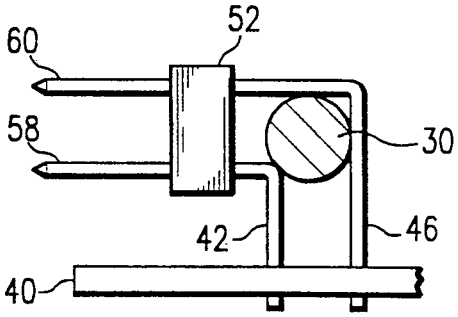
FIG. 4 is a side view of two inline sets of electrical pins with the hinge pin in place therebetween to show the relative spacing.

FIG. 4 provides a side view of the two sets of electrical pins of FIG. 2 along with a hinge pin such as pin 30 and the header 52. An extension of pin 42 is labeled as 58 and would be the portion that is inserted into connector body 54 while an extension of electrical pin 46 as it extends from header 52 is labeled as 60. As will be noted, it is clear that the diameter of hinge pin 30 is greater than the separation distance between the two sets or rows of pins commenced by pins 42 and 46 and is also greater than the spacing between pins 58 and 60 after the right angle is completed. While the separation of the horizontal and vertical portions of the two sets of pins is shown as substantially identical, such identity is not required to practice the invention. It is merely required that the diameter of pin 30 be greater than the spacing between the horizontal portion of the pins if there is no concern for the hinge pins dropping toward the board. It is desirable to have the diameter of pin 30 greater than either the horizontal or vertical spacing of the pins merely to reduce the movement of the retainer 10 and ease its movement towards the enclosure of connector 54 in a retained position or condition.

OPERATION

While the operation of the inventive concept is believed obvious in view of the above, a summary will be provided. The inventive concept comprises designing a retainer element such as 10 of FIG. 1 which will engage with or interlock with a connector such as 54 of FIG. 2. This package of the retainer element 10 and the connector 54 is then held in place by the hinge pins 30 and 32 inserted in the right angle portion of the two sets of pins as illustrated in FIG. 4 between rows of pins 42 and 46. It is necessary, for a preferred embodiment practice of the invention, that the diameter of the hinge pin such as 30 be greater than the spacing between the sets of pins in both the vertical and the horizontal direction. This is possible because of the space dimensions in the right angle portion. With no provision for tolerances, the diameter of pin 30 can be as much as 28% greater than the spacing between the pins such as between pins 42 and 46. In one embodiment of the invention, the spacing between the pins 42 and 46 was 0.075 inches while the diameter of pin 30 was 0.096 inches. This increase in diameter could be more than 28% if the right angle between pin portion 42 and tip 58 is more curved than is illustrated in FIG. 4.

The arms 26 and 28 are flexible enough that the distance between the hinge pins 30 and 32 can be widened to accommodate the distance between electrical pins 46 and 50 to allow the installation of retainer 10 into position in conjunction with the electrical pins and the connector 54. One embodiment of the inventive concept provided shoulders on the pins 30 and 32 with the spacing between the shoulders being the distance between the end pins such as 46 and 50 so as to lessen the lateral or sideways movement of the retainer when it is in the unlatched or upward hinged position and not attached to a connector.

While we have shown one specific embodiment of the inventive concept, it is to be realized that the retainer 10 could be re-designed in many possible forms to attach to the connector such as 54. The tabs 22 and 24 could be inserted in indentations within or on the sides of 54. The extensions 18 and 20 would not be required in such an instance. Also, while the tab 34 was provided for easy removal of the retainer 10 from the connector 54, other means of dis-attachment could be provided. In view of the above, it will be apparent that the inventive concept lies in the use of some type of retainer that coacts in a positive retention manner with a connector and which has extended arms with hinge pins that can coact with a right angle portion of two sets of spaced electrical pins having a right angle section spaced apart from the male portion of the pins used with the electrical connector.

Such a concept is more fully defined in the appended claims wherein we claim:

1. Connector retainer apparatus for use with an electrical connector slidably attached to a set of electrical right angle pins spaced apart by a distance D both directions from an apex of a right angle portion of said pins comprising, in combination:

U-shaped base means, including a bit portion and first and second legs, for enclosing a connector socket body having female portions slidably engaging a set of male right angle electrical connector pins nominally separated by a distance D;

snap action means, comprising a part of said legs of said base means, for positively engaging the connector body to prevent accidental removal therefrom;

third and fourth legs backwardly extending from said first and second legs respectively toward the right angle portion of said male connector pins and each having remote ends; and first and second hinge pin means extending inwardly toward each other from the remote ends of said third and fourth legs respectively and each of said pin means having a diameter of at least 5% greater than said distance D for insertion in the right angle portion of said set of male right angle pins in the right angle portion thereof, the hinge pin means in the right angle portion acting to prevent movement of said base means in other than a rotational direction around said pin means in a hinge-type action.

2. The method of securing an electrical socket to a set of spaced apart right angle electrical pins where the pins are nominally a distance dimension D apart comprising the steps of:

enclosing at least a portion of three sides of an electrical socket with a U-shaped spring action retainer comprising a bit portion and first and second legs;

forcibly engaging the electrical socket with tab extensions at the extremities of said first and second legs for preventing relative movement in a given direction between the socket and the retainer; and hingeably engaging the right angle portion of the spaced apart electrical pins with hinge pin extensions of said retainer where each of the hinge pin extensions have a diameter of greater than said distance dimension D such that the retainer can rotate about an axis of said hinge pin extensions but said axis cannot move in space.

3. Apparatus for securing an electrical socket to a set of spaced apart right angle electrical pins where the pins are nominally a distance dimension D apart comprising, in combination:

U-shaped spring action retainer means for enclosing at least a portion of three sides of an electrical socket, said retainer comprising a bit portion and first and second legs;

tab extensions at the extremities of said first and second legs forcibly engaging an enclosed electrical socket with for substantially preventing relative movement between the socket and the retainer; and hinge pin extensions comprising a further part of said retainer means and including a set of hinge pins for hingeably engaging the right angle portion of the spaced apart electrical pins, each of said hinge pins having a diameter of greater than said distance dimension D such that the retainer can move rotationally about an axis of said pins, but the axis cannot move in space.

4. The method of securing an electrical socket to a set of spaced apart right angle electrical pins where the pins are nominally spaced apart a distance dimension D comprising the steps of:

enclosing at least a portion of three sides of an electrical socket with a U-shaped spring action retainer comprising a bit portion and first and second legs;

forcibly engaging the electrical socket with tab extensions at the extremities of said first and second legs for preventing relative movement between the socket and the retainer; and hingeably engaging the right angle portion of the spaced apart electrical pins with hinge pin extensions of said retainer where each of the hinge pin extensions have a diameter of greater than said distance dimension D such that the retainer cannot move spatially other than to rotate about an axis of said hinge pins.

5. Connector retainer apparatus for use with an electrical connector slidably attached to a set of electrical right angle pins spaced apart by a distance D in both directions from a right angle portion of said pins comprising, in combination:

U-shaped base means, including a bit portion and first and second legs, for enclosing a connector socket body having female portions slidably contacting a set of male right angle electrical connector pins nominally separated by a distance D;

snap action means, comprising a part of said legs of said base means, for positively engaging the connector body to prevent accidental removal therefrom;

third and fourth legs backwardly extending from said first and second legs respectively toward the right angle portion of said male connector pins and each having remote ends; and first and second hinge pin means extending inwardly toward each other from the remote ends of said third and fourth legs respectively, and each of said pin means having a diameter of substantially 22% greater than said distance D for insertion in the right angle portion of said set of male right angle pins in the right angle portion thereof, the hinge pin means in the right angle portion acting to prevent movement of said base means in other than a rotational direction around said pin means in a hinge-type action.

6. Connector retainer apparatus comprising, in combination:

two inline sets of right angle male electrical pins spaced apart by a distance D and having a right angle portion defined therebetween;

connector socket body having female portions slidably contacting said sets of right angle male electrical pins and electrically interconnected thereto;

U-shaped base means, including a bit portion and first and second legs, for enclosing said connector socket body, said base means further including third and fourth legs backwardly extending from said first and second legs respectively toward said right angle portion of said male connector pins and each having remote ends;

snap action means, comprising a part of said first and second legs of said base means, for positively engaging the connector body to prevent accidental removal therefrom; and first and second hinge pin means extending inwardly toward each other from the remote ends of said third and fourth legs respectively, and each of said pin means having a diameter greater than said distance D for insertion in said right angle portion of said set of male right angle pins.

* * * * *